US007464570B1

(12) United States Patent
Chen

(10) Patent No.: US 7,464,570 B1
(45) Date of Patent: Dec. 16, 2008

(54) TIME PROGRAMMABLE UNLOCKING LOCK

(75) Inventor: Chih-Jung Chen, Sinjhih (TW)

(73) Assignee: Co-Young International Co., Ltd., Taipei (TW)

( * ) Notice: Subject to any disclaimer, the term of this patent is extended or adjusted under 35 U.S.C. 154(b) by 0 days.

(21) Appl. No.: 12/037,863

(22) Filed: Feb. 26, 2008

(51) Int. Cl.
*E05B 43/00* (2006.01)

(52) U.S. Cl. ..... 70/267; 70/269; 70/270; 70/278.7; 109/59 R; 109/59 T

(58) Field of Classification Search ..... 70/210, 70/267–274, 277, 278.1, 278.4–278.7, 279.1, 70/283, DIG. 45, DIG. 50; 109/59 R, 59 T; 292/144

See application file for complete search history.

(56) References Cited

U.S. PATENT DOCUMENTS

| | | | | | |
|---|---|---|---|---|---|
| 214,045 | A * | 4/1879 | Kook et al. | 70/274 |
| 215,777 | A * | 5/1879 | Shaw | 70/267 |
| 2,171,263 | A * | 8/1939 | Bremer | 109/46 |
| 2,823,536 | A * | 2/1958 | Watson | 70/1.5 |
| 2,947,160 | A * | 8/1960 | Wolters | 70/1.5 |
| 2,956,525 | A * | 10/1960 | Blauvelt | 109/59 R |
| 4,854,619 | A * | 8/1989 | Nakauchi | 292/335 |
| 4,944,170 | A * | 7/1990 | Jolidon et al. | 70/267 |
| 5,142,890 | A * | 9/1992 | Uyeda et al. | 70/277 |
| 5,196,841 | A * | 3/1993 | Harder et al. | 340/5.73 |
| 5,839,306 | A * | 11/1998 | Nunuparov | 70/283 |
| 5,942,973 | A * | 8/1999 | Lee | 340/542 |
| 6,032,499 | A * | 3/2000 | Juillerat et al. | 70/267 |
| 6,434,987 | B1 * | 8/2002 | Juillerat et al. | 70/333 R |
| 6,666,054 | B1 * | 12/2003 | Hsieh | 70/257 |
| 2003/0070458 | A1 * | 4/2003 | Huang | 70/283 |
| 2003/0140665 | A1 * | 7/2003 | Szuminski et al. | 70/257 |
| 2003/0230124 | A1 * | 12/2003 | Johnson et al. | 70/267 |
| 2006/0032418 | A1 * | 2/2006 | Smith | 109/59 R |

* cited by examiner

*Primary Examiner*—Lloyd A Gall

(57) ABSTRACT

A time programmable unlocking lock includes a tenon structure assembly, wherein the tenon structure assembly includes a front and a rear retaining plate, the front retaining plate connects to an inner side of a door and has a round hole for a tenon of the rear retaining plate to go through, the rear retaining plate has a slot disposed thereon and cooperates with a flange to slidingly connect to the inner side of the door, a front end of the rear retaining plate connects with the tenon, a rear end of the rear retaining plate connects with a metal plate, and the front retaining plate connects with the rear retaining plate through a compression spring. A timer device is disposed at the inner side of the door and controls the circuit operation, the timer setting and the counter setting of the time programmable unlocking lock.

4 Claims, 12 Drawing Sheets

TIME PROGRAMMABLE UNLOCKING LOCK

BACKGROUND OF THE INVENTION

1. Field of the Invention

The present invention relates to a lock, and more particularly, to a time programmable unlocking lock.

2. Description of the Prior Art

Locks have been used by people for over a thousand years. From the oldest tied ropes to wooden tenon to various kinds of electronics locks and mechanical locks, they are provided for protecting assets and security of people and improving human safety.

However, locks have to be installed on the outside of the door for a person to unlock the door with a key, when someone tries to break in the door, he/she often has to break the lock for allowing a forced entry. Besides, keys are small and easy to lose, if a key is accidentally lost, it would take a locksmith to unlock the door or even replace the whole lock, which would produce additional cost. Therefore, one of the solutions to the current deficiencies of locks is to hide the lock in a hard-to-find place, such as the Taiwan Utility Patent No. M284730, which discloses a keyless lock using electronic sensor to release the lock, although in this case there's no lock exposed externally, the user still has to carry a sensor controller for the lock, once he/she loses the controller, the same problem occurs.

In places such as warehouses or department stores, it is often that a person in charge should keep the keys to the doors, when that person is not able to show up on time, other workers have to wait, which could mean business loss to the company.

In view of the deficiencies of traditional locks, after years of constant efforts, the inventor of the present invention have developed and proposed a time programmable unlocking lock and its application to replace the traditional locks.

SUMMARY OF THE INVENTION

It is an object of the present invention to provide a time programmable unlocking lock which uses a timer device to set up time rules for financial management of the company.

It is another object of the present invention to provide a time programmable unlocking lock which is independently powered to avoid forced entry and thus to protect the properties and assets stored within.

It is still another object of the present invention to provide a time programmable unlocking lock installed at a hidden place such as the inner side of the door, therefore there's no lock or electrical signal receiver in appearance to improve security.

In order to implement these various objects, the present invention discloses a time programmable unlocking lock, which comprises:

a tenon structure assembly, wherein the tenon structure assembly comprises a front and a rear retaining plate, the front retaining plate connects to an inner side of a door and has a round hole for a tenon of the rear retaining plate to go through, the rear retaining plate has a slot disposed thereon and cooperates with a flange to slidingly connect to the inner side of the door, a front end of the rear retaining plate connects with the tenon, a rear end of the rear retaining plate connects with a metal plate, the front retaining plate connects with the rear retaining plate through a compression spring;

a timer device which is disposed at the inner side of the door, the timer device controls the circuit operation, the timer setting and the counter setting of the time programmable unlocking lock;

a magnetic valve which is disposed and connected nearby the timer device, the valve has its top disposed with a cylindrical tenon; and a connecting rod which is disposed on top of the cylindrical tenon of the magnetic valve and connected to the door through a spring.

Compared with traditional techniques, the present invention is advantageous in that through the combination of the mechanical structure and the timer device, the time programmable unlocking lock can be installed at places such as business centers, warehouses, department stores, convenient stores or shopping malls which have regular open hours and large cash flows. The lock can be set to open at the time when policemen or security guards are around to protect cash withdrawal/deposit to safely guard the assets; meanwhile the company can use the timer to adjust the open time of the lock according to the open hours of the bank, and the accountant of the company can withdraw the money stored in the safe at that time and deposit it at the bank, thereby providing a convenient management mode for the company to regulate its financial policy and personnel risk control strategy.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
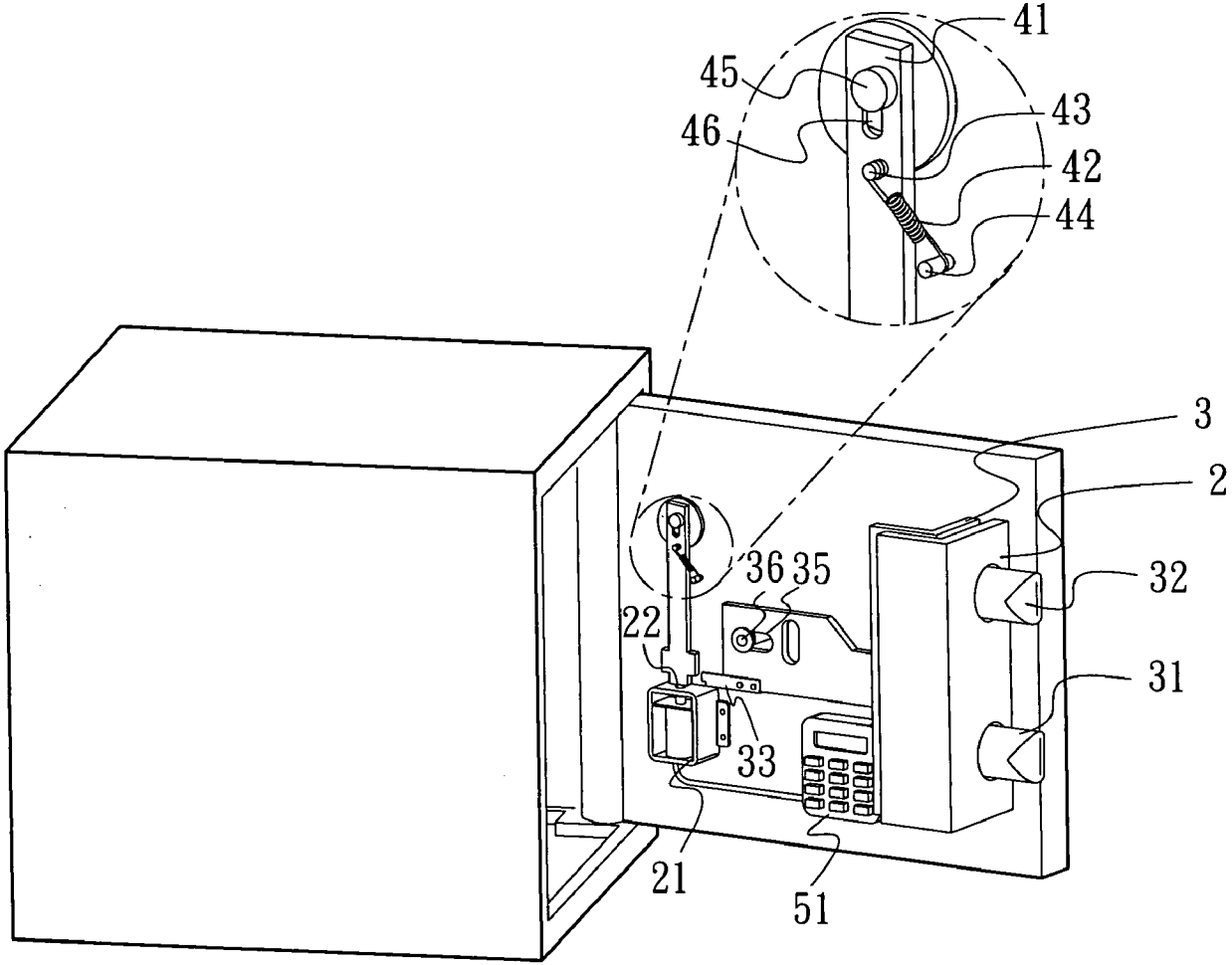
FIG. 1 illustrates a perspective view of the present invention.
Figure 3A:
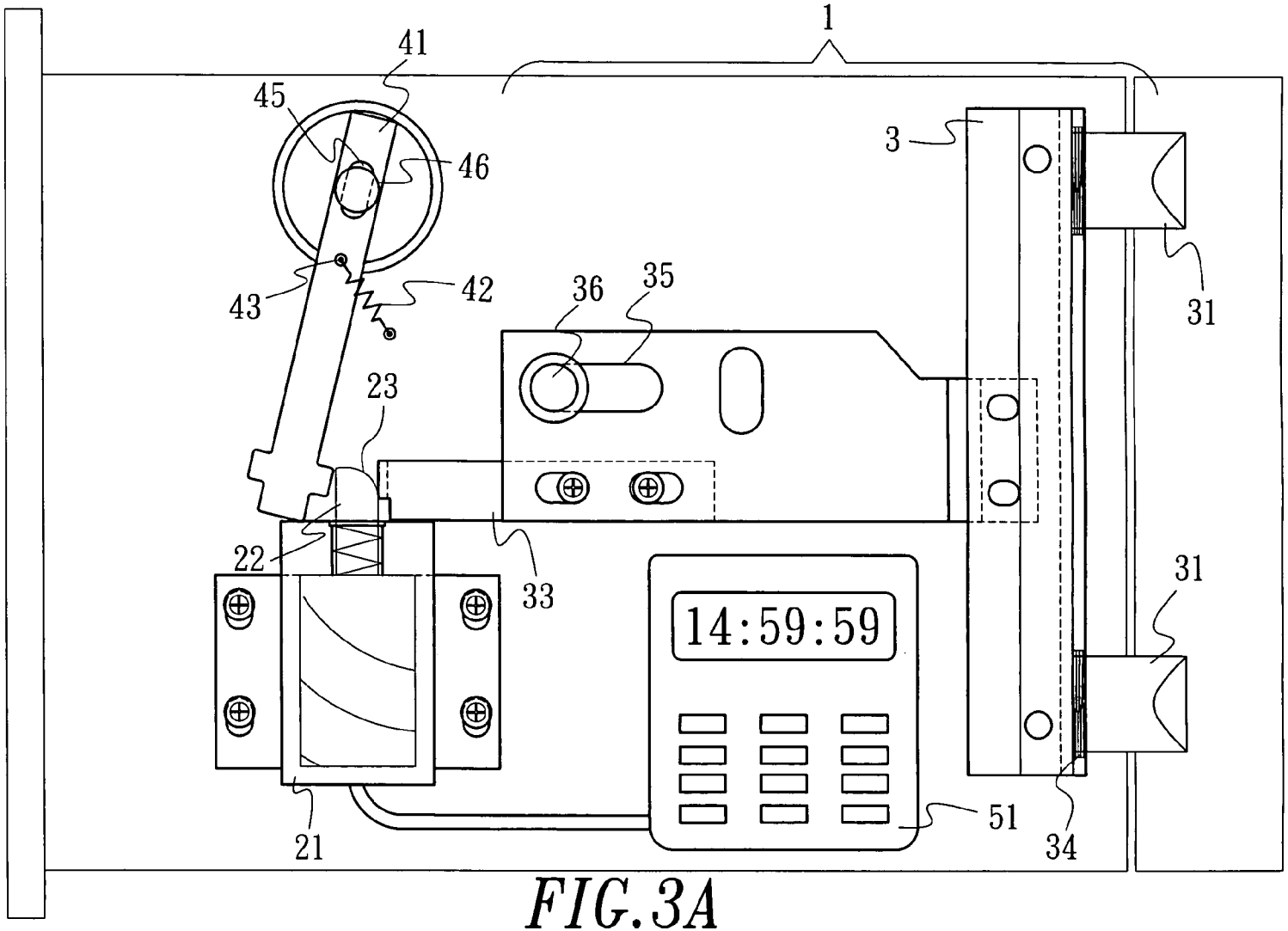
FIGS. 3A, 3B, 3C and 3D illustrate the relative positions of the present invention in unlocking sequences.

Please refer to FIG. 1 and FIG. 3A for a time programmable unlocking lock disclosed in the present invention and installed at a hidden place. The time programmable unlocking lock comprises a tenon structure assembly 1, a timer device 51, a magnetic valve 21 and a connecting rod 41. The tenon structure assembly 1 comprises a front retaining plate 2 fixedly connecting to the inner side of the door, the front retaining plate 2 has a round hole for a tenon 31 to go through, a rear retaining plate 3 is disposed in parallel to the front retaining plate 2 and slidingly cooperate with the front retaining plate 2 through a slot 35 and a flange 36 on the inner side of the door, and the flange 36 connects to the inner side of the door, The rear retaining plate 3 has a front end connected with a tenon 31, and the front retaining plate 2 connects with the rear retaining plate 3 through a compression spring 34. The tenon structure assembly 1 is thus formed by the components described above. A timer device 51 is installed at the lower side of the rear retaining plate 3 and controls the operation of the tenon 22 of the magnetic valve 21 through electronics circuit. A connecting rod 41 is disposed on top of the tenon 22 of the magnetic valve 21, the connecting rod 41 is disposed with a slot 45 to cooperate with a flange 46 for allowing the connecting rod 41 to swing back and forth, and the flange 46 connects to the inner side of the door. A flange 43 is disposed on the connecting rod 41 and connects to a spring 42 for enhancing the operating force of the spring 42, the spring 42 has its other end connected to the flange 44, and the flange 44 connects to the inner side of the door. When the time programmable unlocking lock unlocks, the lower portion of the connecting rod 41 sticks against the tenon 22 of the magnetic valve 21; meanwhile, a side of the connecting rod 41 makes contact with a metal plate 33 connected with the end of the rear retaining plate 3 (see FIG. 3B).

Figure 2:
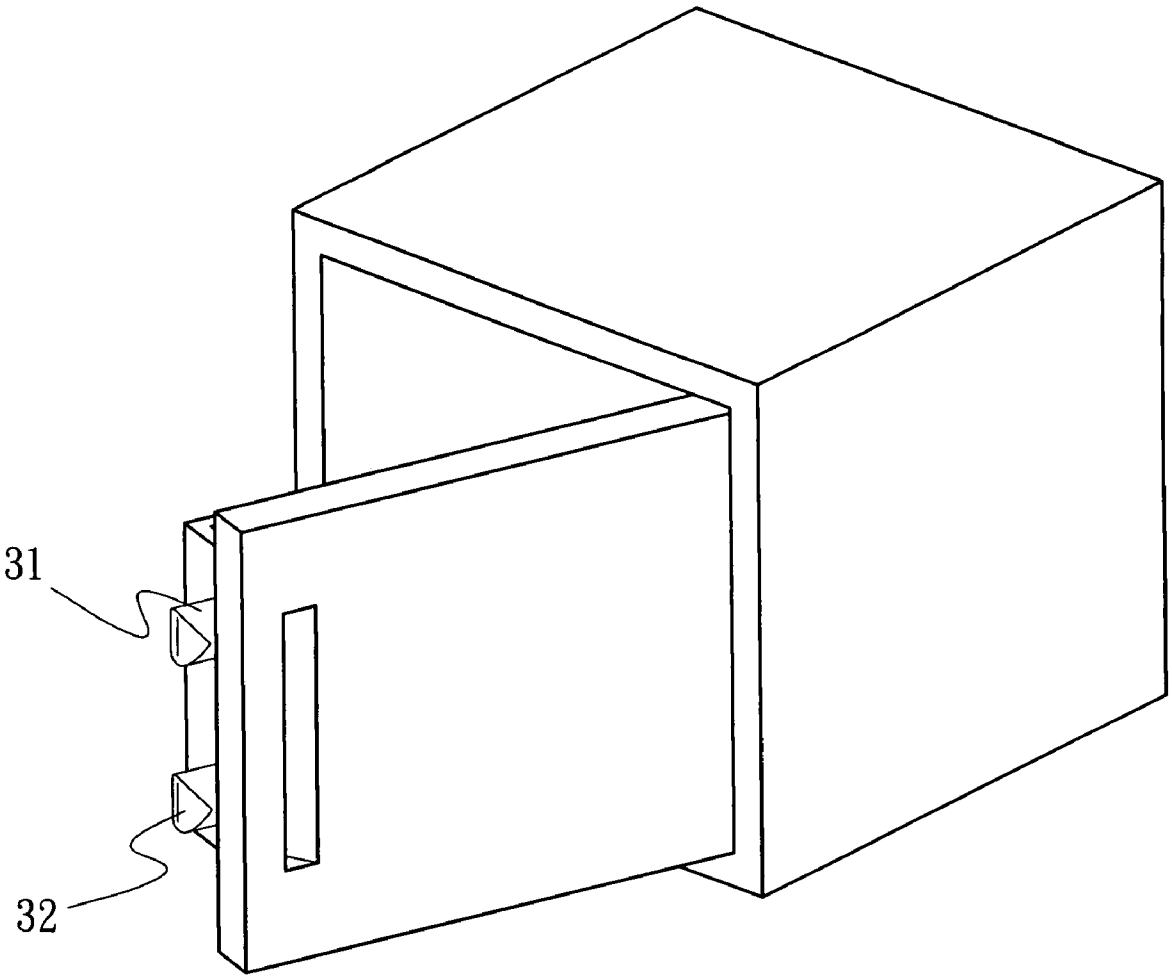
FIG. 2 illustrates a partially perspective view of the present invention.

Please refer to FIG. 2, the tenon 31 connects to the rear retaining plate 3 and has an arc 32 disposed thereon, and the arc is designed to be semi-circular to enhance the friction force when the door closes/opens.

Please refer to FIG. 3A, the tenon 22 of the magnetic valve 21 sticks against the connecting rod 41 and the metal plate 33 of the rear retaining plate 3 to stop the operation of the tenon structure assembly 1 and to lock the door.

Figure 3B:
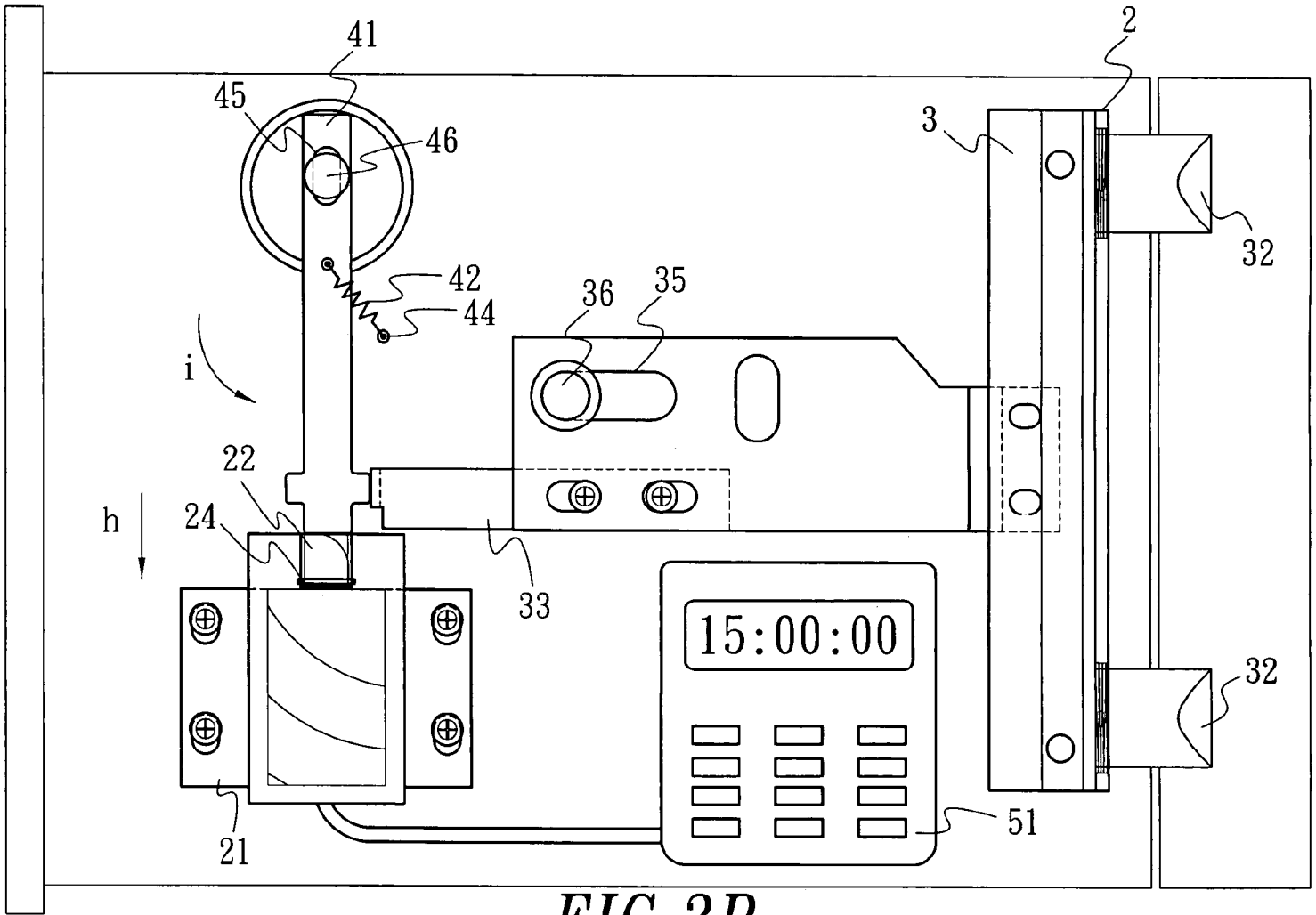

Please refer to FIG. 3B, when the time comes the timer device 51 controls the tenon 22 of the magnetic valve 21 to retract downward (see movement "h"), in the mean time the connecting rod 41 swings downward by the cooperation of the slot 45 and the flange 44 and the operating force of the spring 42, thus the connecting rod 41 swings downward to the top of the tenon 22 and sticks against the tenon 22 (see movement "i"), thus the tenon 22 won't bounce in the presence of the spring force of the spring 24.

Figure 3C:
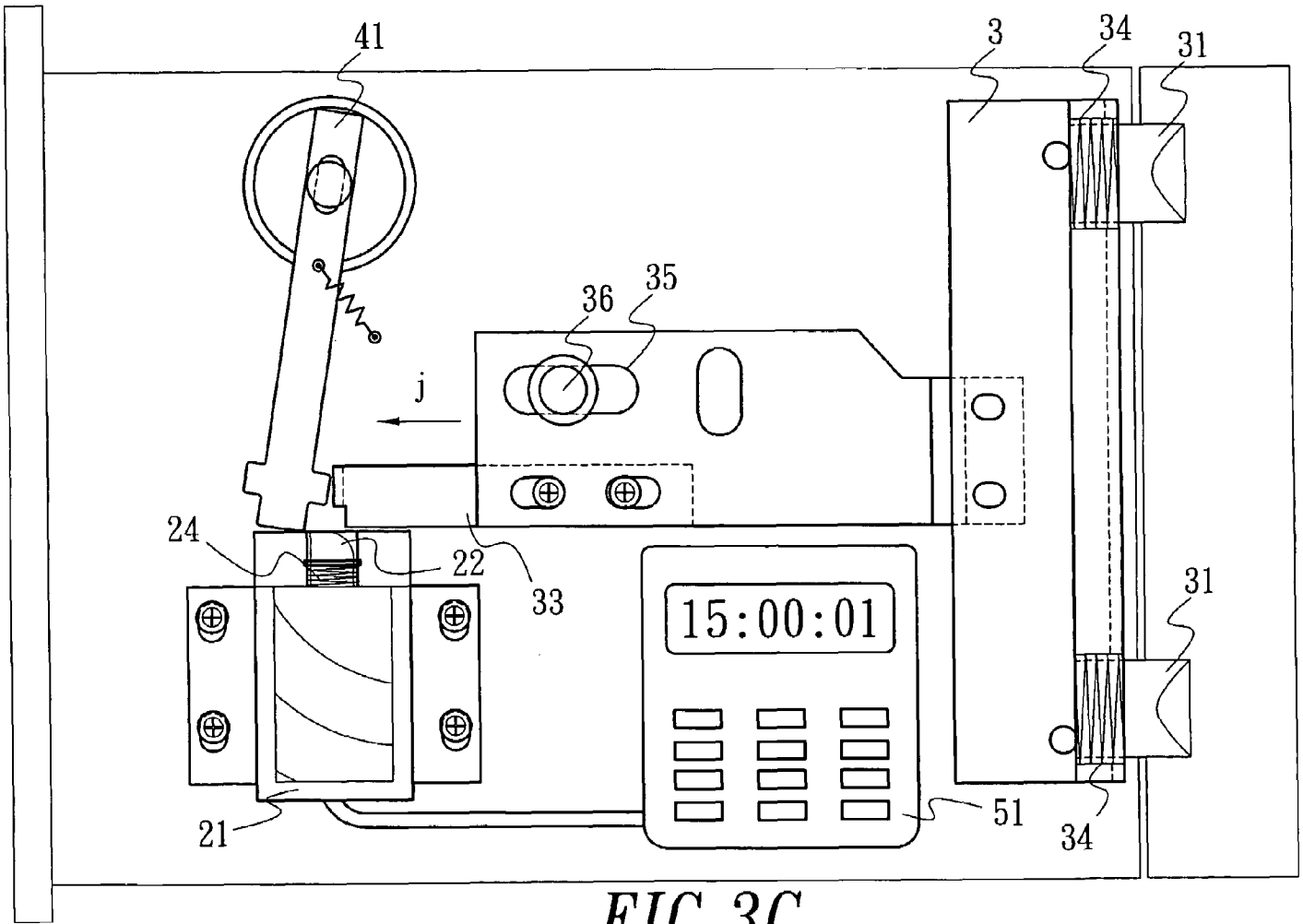
Figure 3D:
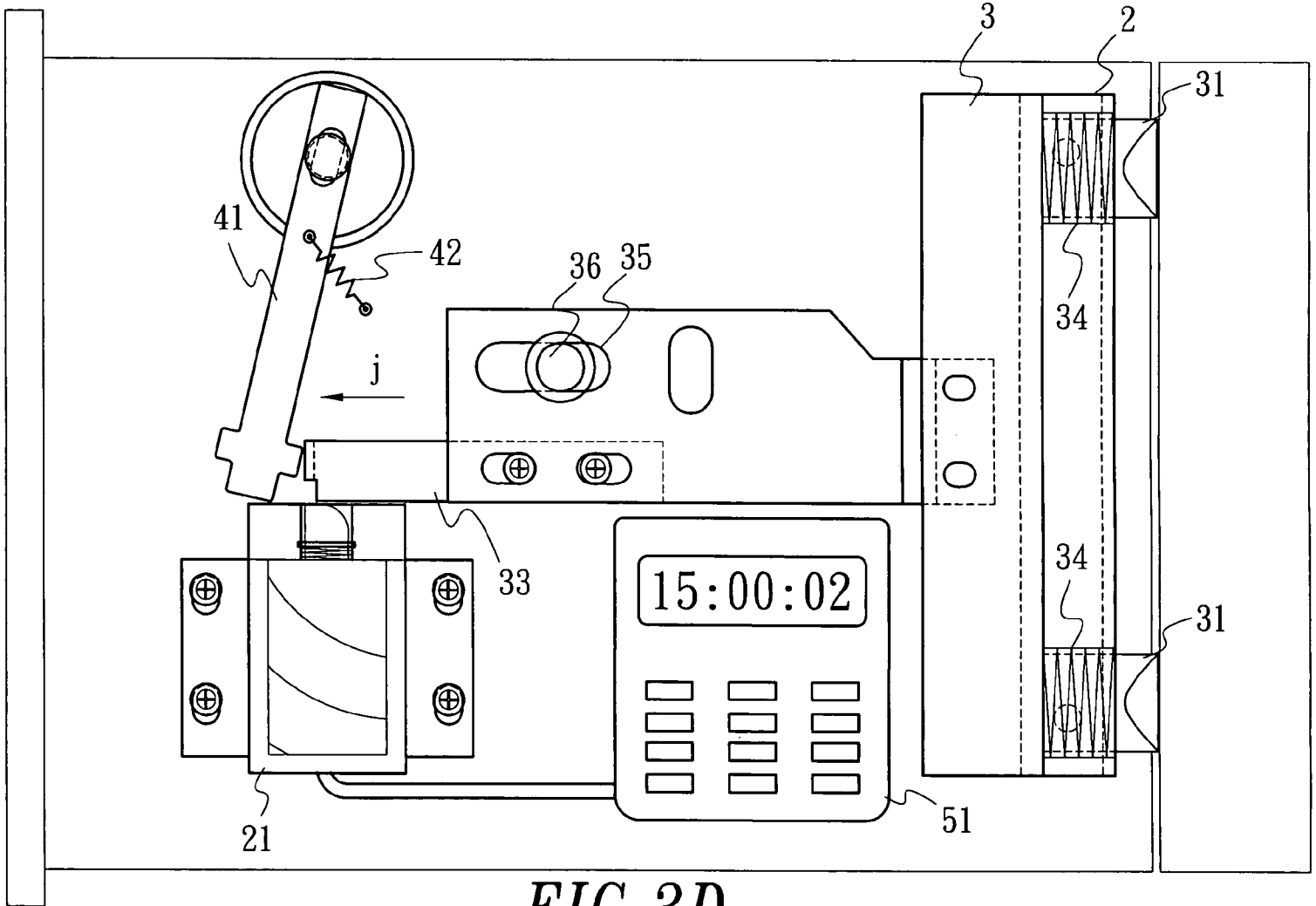
Figure 3E:
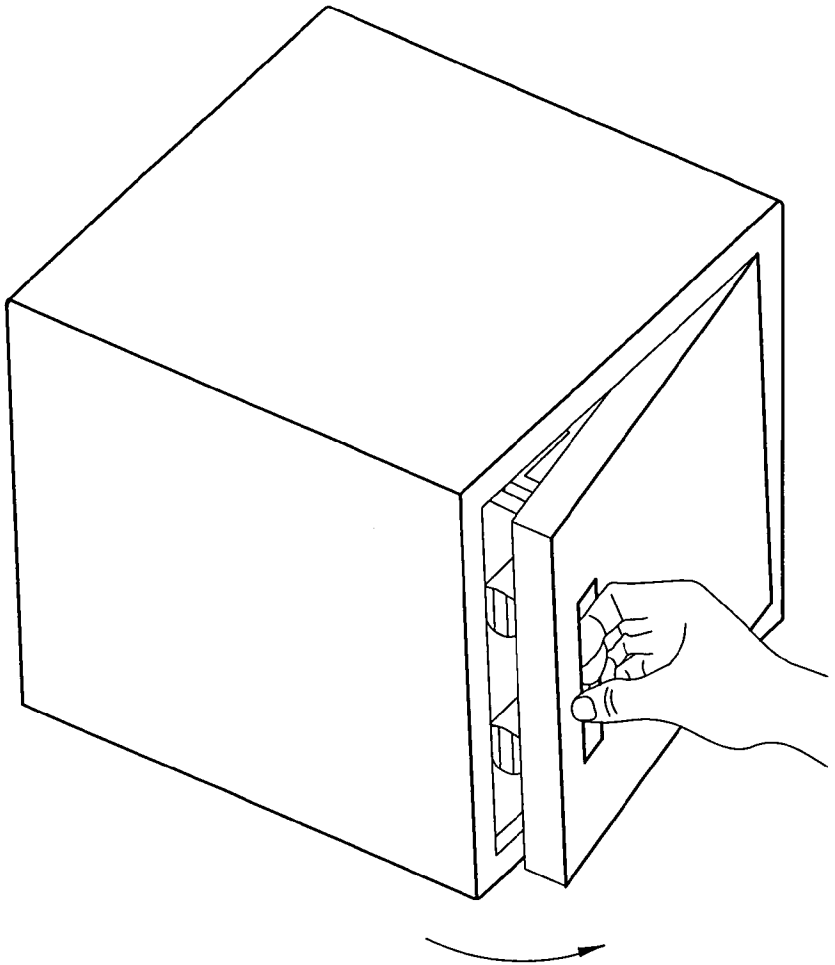
FIG. 3E illustrates the present invention in an open state.

Please refer to FIG. 3C, FIG. 3D and FIG. 3E, when someone opens the door, the operating force of the compression spring 34 between the front retaining plate 2 and the rear retaining plate 3 and the friction force of the arc 32 on the tenon 31 retract the tenon 31 to open the door. Meanwhile, the compression spring 34 drives the rear retaining plate 3 to slide along the slot 35 with the flange 36 to connect the metal plate 33 of the rear retaining plate 3 with the tenon 22 and to stick against the tenon 22 (see movement j), thus the tenon 22 won't bounce in the presence of the spring force of the spring 24.

Figure 3F:
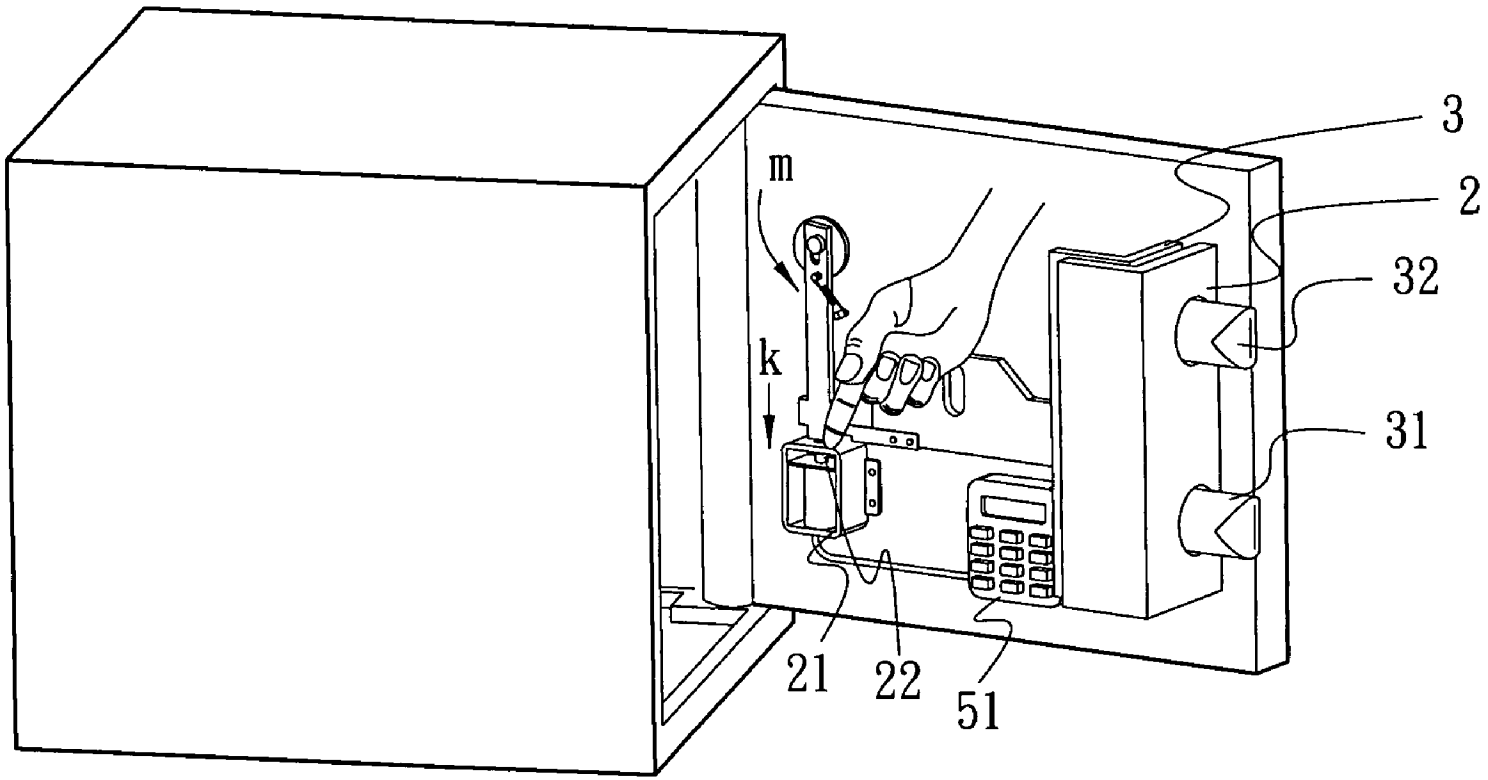
FIG. 3F illustrates how to manually disable the time programmable unlocking lock in the present invention.
Figure 3G:
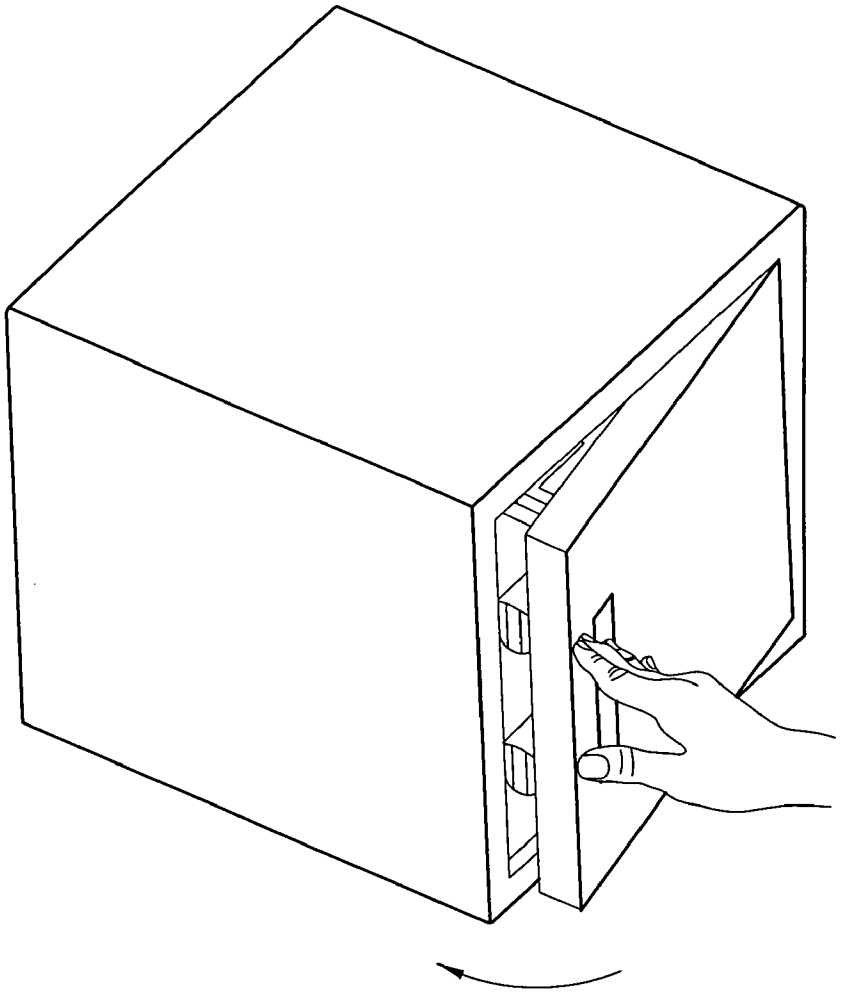
FIG. 3G illustrates the present invention in a close state.

Please refer to FIG. 3F, when someone closes the door, he/she has to manually press the tenon 22 (see movement k) to hold the connecting rod 41 vertically (see movement m) to close the door, as shown in FIG. 3G. When the door is closed, as shown in FIG. 3A, the operating force of the compression spring 34 between the front retaining plate 2 and the rear retaining plate 3 and the friction force of the arc 32 on the tenon 31 drive the tenon 31 of the rear retaining plate 3 to stick out and to retract the rear retaining plate 3, in the mean time, the tenon 22 of the magnetic valve 21 bounces by the spring force of the spring 24, and a inclined surface 23 of the tenon 22 provides buffering effect for the metal plate 33 of the rear retaining plate 3 to retract and the tenon 22 to stick out completely to stick against the connecting rod 41 and the metal plate 33, thus the tenon structure assembly 1 stops operation and the door locks.

Figure 4B:
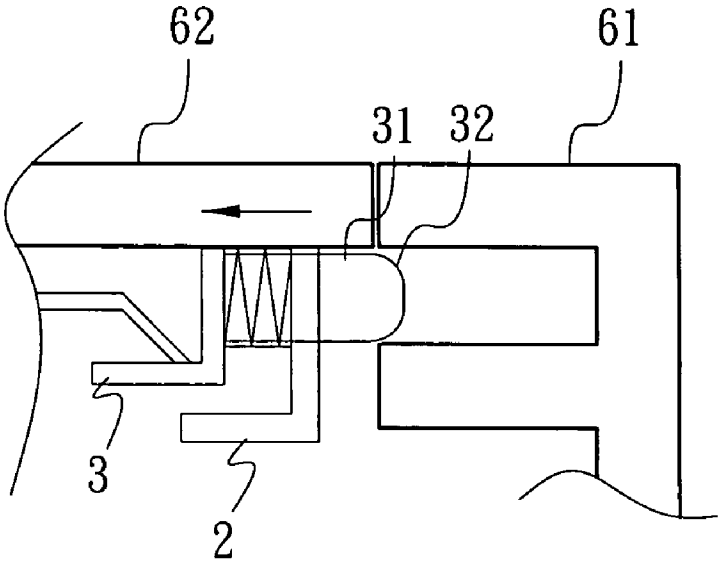
FIGS. 4A, 4B, 4C and 4D illustrate the operations of the present invention.
Figure 4A:
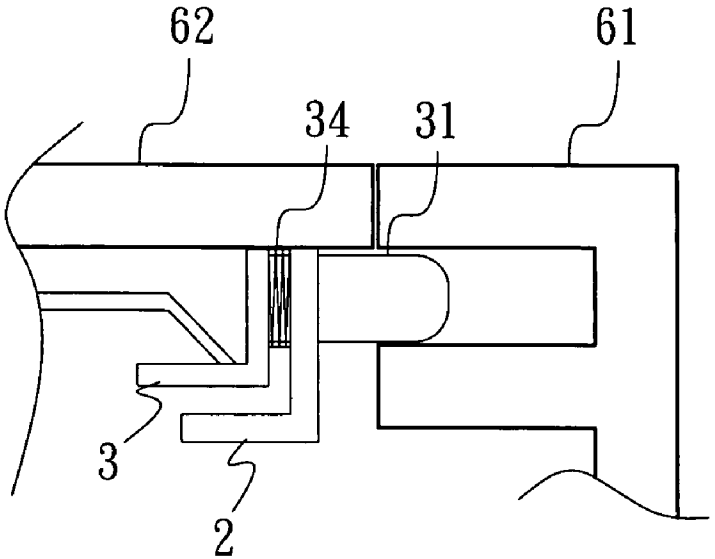
Figure 4D:
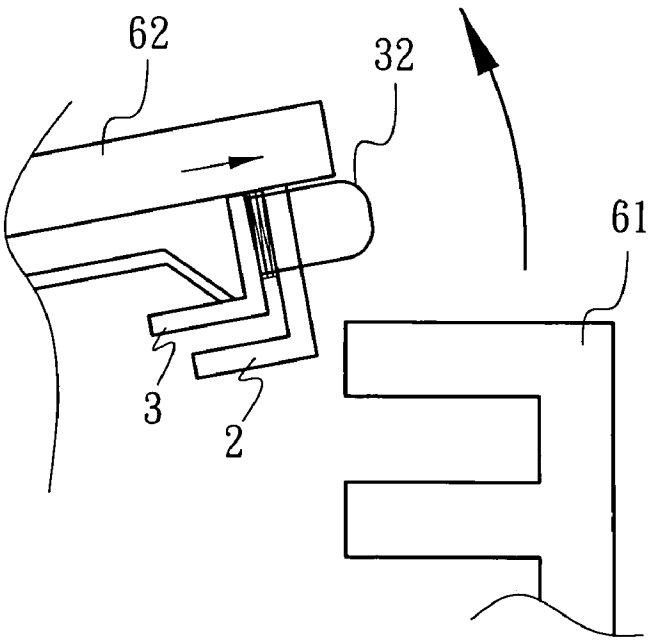
Figure 4C:
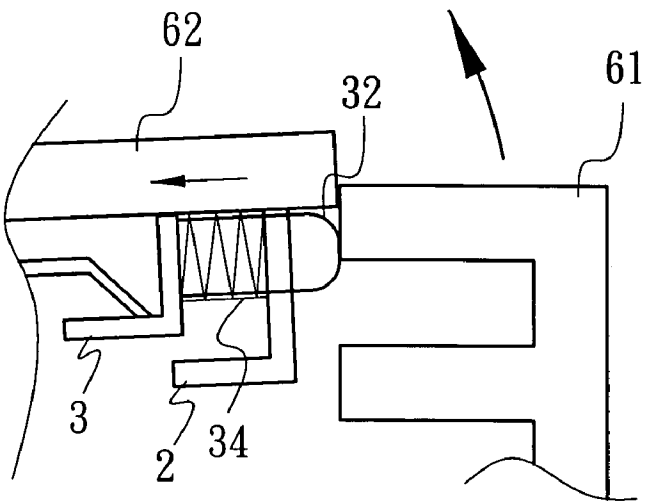

Please refer to FIG. 4A to FIG. 4D with reference to FIG. 3A and FIG. 3F for the operation of the front retaining plate 2, the rear retaining plate 3, the tenon 31 and the compression spring 34. When the door locks, the relative positions of the four components are shown in FIG. 4A; when the timer device operates, the compression spring 34 drives the rear retaining plate 3 and the tenon 31 to retract the tenon 31, as shown in FIG. 4B; when someone opens the door, the operating force of the compression spring 34 and the arc 32 stick against the inner side of the fixed end 61 of the door, at this moment the door is kept open, the compression spring 34 sticks out to the left for the tenon 31 to pass through the fixed end 61 of the door, as shown in FIG. 4C; when the door is completely opened, the operating force of the compression spring 34 retract the the compression spring 34 and to drive the rear retaining plate 3 and the tenon 31 to let the tenon 31 stick out to the right, in the mean time, the rear retaining plate 3 retracts as well, as shown in FIG. 4D. Please refer to FIG. 3F and FIG. 3A, since the tenon 22 of the magnetic valve 21 blocks the door lock, so one has to manually press the tenon 22 (see movement "k") to hold the connecting rod 41 vertically (see movement "m") so as to close the door, thus the time programmable unlocking lock returns to the tenon locking state.

Figure 5B:
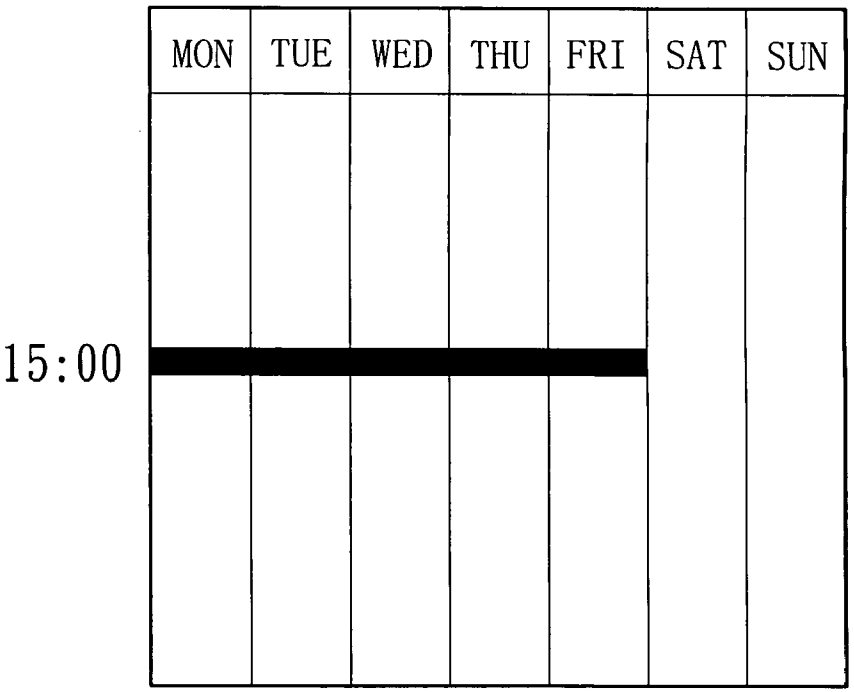
FIG. 5A and FIG. 5B illustrate working periods in the embodiment of the present invention.
Figure 5A:
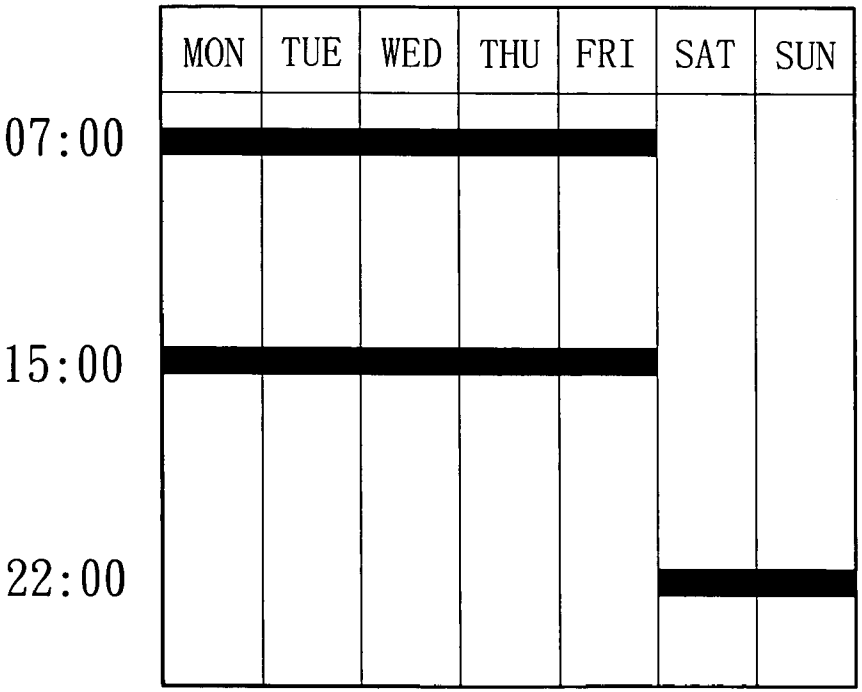

Please refer to FIG. 5A and FIG. 5B, in the present invention, the time programmable unlocking lock can be installed at places such as business centers, warehouses, department stores, convenient stores or shopping malls and set to open at specific times in the morning and the afternoon, from Monday through Friday. Financial personnel will be informed of the specific times to withdrawal/deposit cash from the safe to deposit it at the bank. Besides, it is possible to adjust the unlocking time based on weekend or holiday for accounting purpose, as shown in FIG. 5A. At places with security concerns, such as 24-hour convenient store or shopping mall, the lock can be set to open at the time when policemen or security guards are around to protect cash withdrawal/deposit to safely guard the assets; while in companies or warehouses, the lock can be set to open at specific time on Monday through Friday and close for all weekend, thereby providing a convenient management mode for the company to regulate its financial policy and personnel risk control strategy.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A time programmable unlocking lock comprising:

a tenon structure assembly, comprising a front and a rear retaining plate, the front retaining plate connecting to an inner side of a door and having a round hole for a tenon of the rear retaining plate to go through, the rear retaining plate having a slot disposed thereon and cooperating with a flange to slidingly connect to the inner side of the door, a front end of the rear retaining plate connecting with the tenon, a rear end of the rear retaining plate connecting with a metal plate, the front retaining plate connecting with the rear retaining plate through a compression spring;

a timer device disposed at the inner side of the door, the timer device controlling a circuit operation, a timer setting and a counter setting of the time programmable unlocking lock;

a magnetic valve disposed and connected nearby the timer device, the valve having its top disposed with a cylindrical tenon; and a connecting rod disposed on top of the cylindrical tenon of the magnetic valve and connected to the door through a spring.

2. The time programmable unlocking lock of claim 1, wherein the timer device is independently powered.

3. The time programmable unlocking lock of claim 1, wherein the tenon in the tenon structure assembly is in semi-circular shape.

4. The time programmable unlocking lock of claim 1, wherein the tenon structure assembly comprises a plurality of tenons.

* * * * *